US010479631B1

(12) United States Patent
Yu Chen

(10) Patent No.: US 10,479,631 B1
(45) Date of Patent: Nov. 19, 2019

(54) STRETCH FILM DISPENSER WITH MOVING DEVICE

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 0 days.

(21) Appl. No.: 16/112,763

(22) Filed: Aug. 26, 2018

(51) Int. Cl.
*B65H 16/06* (2006.01)
*B65H 16/10* (2006.01)
*B65H 16/00* (2006.01)

(52) U.S. Cl.
CPC ..... *B65H 16/06* (2013.01); *B65H 16/005* (2013.01); *B65H 16/106* (2013.01); *B65H 2402/412* (2013.01)

(58) Field of Classification Search
CPC .... B65H 16/06; B65H 16/106; B65H 16/005; B65H 2402/412
See application file for complete search history.

(56) References Cited

U.S. PATENT DOCUMENTS 4,102,513 A * 7/1978 Guard ..... B65B 67/085 156/577
4,166,589 A * 9/1979 Hoover ..... B65B 67/085 156/577
4,535,951 A * 8/1985 Riemenschneider, III ..... B65B 67/085 242/423.2
4,714,211 A * 12/1987 Hwang ..... B65B 67/085 242/423.1
5,779,179 A * 7/1998 Zentmyer ..... B65B 67/085 242/423.2
6,883,298 B2 * 4/2005 Gooding ..... B65B 67/085 156/574
6,920,742 B1 * 7/2005 Yu Chen ..... B65B 67/085 156/574
7,228,677 B2 * 6/2007 Yu Chen ..... B65B 67/085 242/570
7,357,349 B1 * 4/2008 Huang ..... B65B 67/085 242/405.3
8,317,124 B2 * 11/2012 Yu Chen ..... B65B 67/085 242/588.6
10,059,548 B2 * 8/2018 Chen ..... B65H 23/14
10,167,101 B2 * 1/2019 Yu Chen ..... B65B 67/08
2002/0038838 A1 * 4/2002 Marois ..... B65H 16/06 242/596.6
2003/0208994 A1 * 11/2003 Gooding ..... B65B 67/085 53/557
2011/0233321 A1 * 9/2011 Yu Chen ..... B65B 67/085 242/588.2
2015/0353215 A1 * 12/2015 Yu Chen ..... B65H 16/005 53/203

(Continued)

*Primary Examiner* — William A. Rivera
(74) *Attorney, Agent, or Firm* — Bruce Stone LLP; Joseph Bruce

(57) ABSTRACT

A stretch film dispenser with a moving device includes a frame. The frame includes a bottom seat and a coupling seat. A tubular member is connected between the bottom seat and the coupling seat. The tubular member is provided with a telescopic rod. The bottom seat is provided with a moving unit. A bottom surface of the moving unit is provided with at least two first moving members. When in use, the telescopic rod is pulled to a height suitable for holding, and then the user holds the telescopic rod to pull the stretch film dispenser. The stretch film dispenser can be moved through the moving unit, thereby achieving the effect of moving the stretch film dispenser easily and conveniently.

10 Claims, 10 Drawing Sheets

(56) References Cited

U.S. PATENT DOCUMENTS

| | | | | |
|---|---|---|---|---|
| 2016/0340070 | A1* | 11/2016 | Yu Chen | B65B 67/08 |
| 2016/0355373 | A1* | 12/2016 | Yu Chen | B65H 23/14 |
| 2017/0305583 | A1* | 10/2017 | Nelson | B65H 16/005 |
| 2018/0065827 | A1* | 3/2018 | Nelson | B65H 16/005 |

* cited by examiner

STRETCH FILM DISPENSER WITH MOVING DEVICE

FIELD OF THE INVENTION

The present invention relates to a stretch film dispenser, and more particularly to a stretch film dispenser with a moving device.

BACKGROUND OF THE INVENTION

In order to increase the efficiency of product packaging, a stretch film dispenser is used for packing products. When in use, the film is adhered to the surface of an article, and then the user holds the stretch film dispenser with both hands to wrap the surface of the article quickly.

However, the stretch film dispenser mounted with a film roll has a certain weight. When the user wants to wrap an article that is located at a lower position or when the user wants to move the stretch film dispenser, it is quite laborious. Sometimes, the user may strain his/her waist and hands. Accordingly, the inventor of the present invention has devoted himself based on his many years of practical experiences to solve these problems.

SUMMARY OF THE INVENTION

The present invention is to provide a stretch film dispenser with a moving device. The bottom of the stretch film dispenser is equipped with the moving device, so that the stretch film dispenser can be moved conveniently.

In order to achieve the aforesaid object, a stretch film dispenser with a moving device is provided. The stretch film dispenser comprises a frame. The frame includes a bottom seat and a coupling seat. A tubular member is connected between the bottom seat and the coupling seat. The tubular member is provided with a telescopic rod. A side wall of the bottom seat has a first positioning portion. A first positioning block is disposed on the first positioning portion. A moving unit is provided on the first positioning portion of the bottom seat. The moving unit has a first engaging trough corresponding to the first positioning portion. A peripheral wall of the first engaging trough has a first positioning groove corresponding in position to the first positioning block. The moving unit is engaged with the first positioning portion of the bottom seat. A bottom surface of the moving unit is provided with at least one first moving member.

When in use, the telescopic rod is pulled to a height suitable for holding, and then the user holds the telescopic rod to pull the stretch film dispenser. The stretch film dispenser can be moved through the moving unit, thereby achieving the effect of moving the stretch film dispenser easily and conveniently.

DETAILED DESCRIPTION OF THE PREFERRED EMBODIMENTS

Embodiments of the present invention will now be described, by way of example only, with reference to the accompanying drawings.

Figure 1:
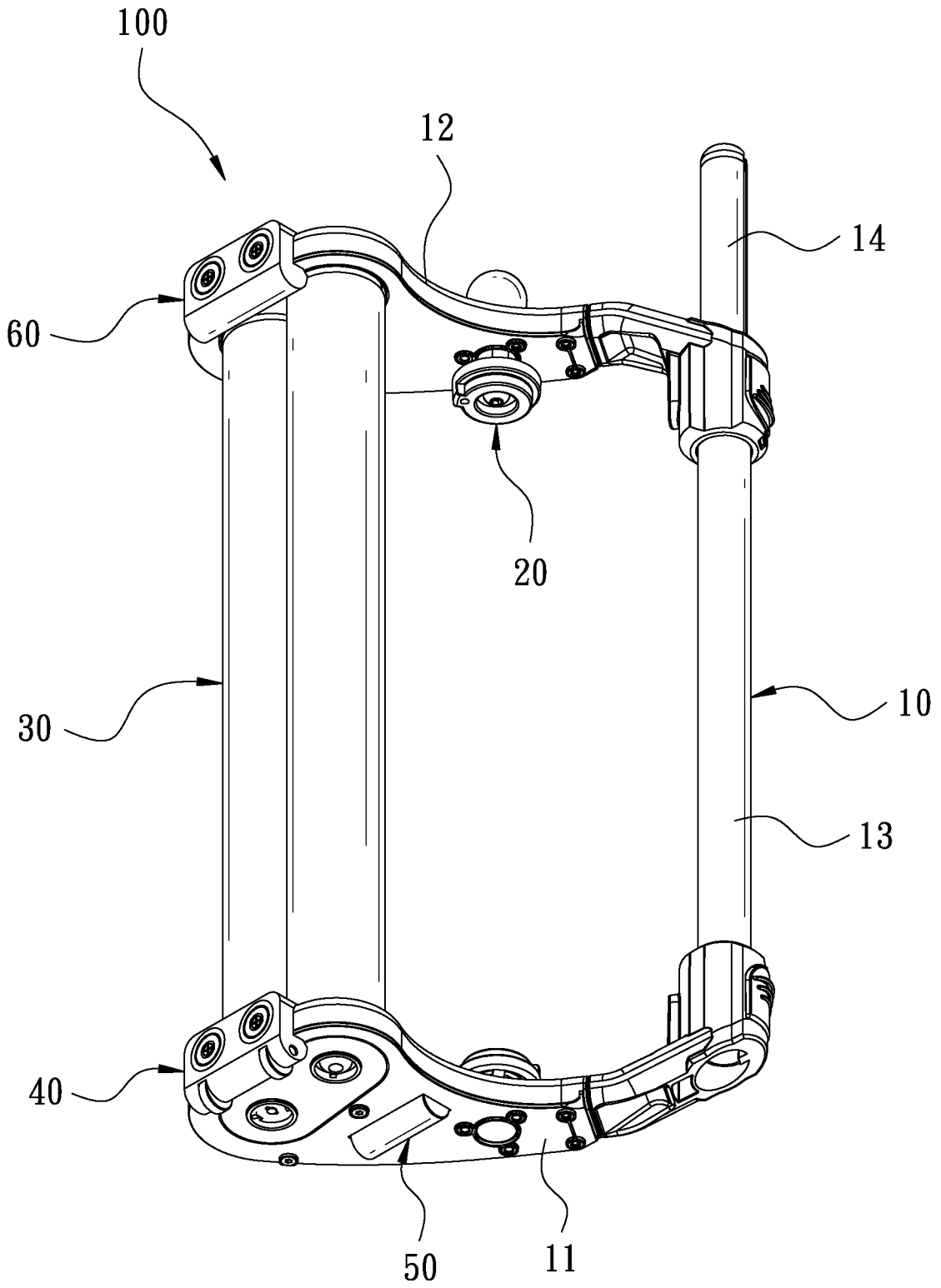
FIG. 1 is a perspective view according to a preferred embodiment of the present invention.
Figure 2:
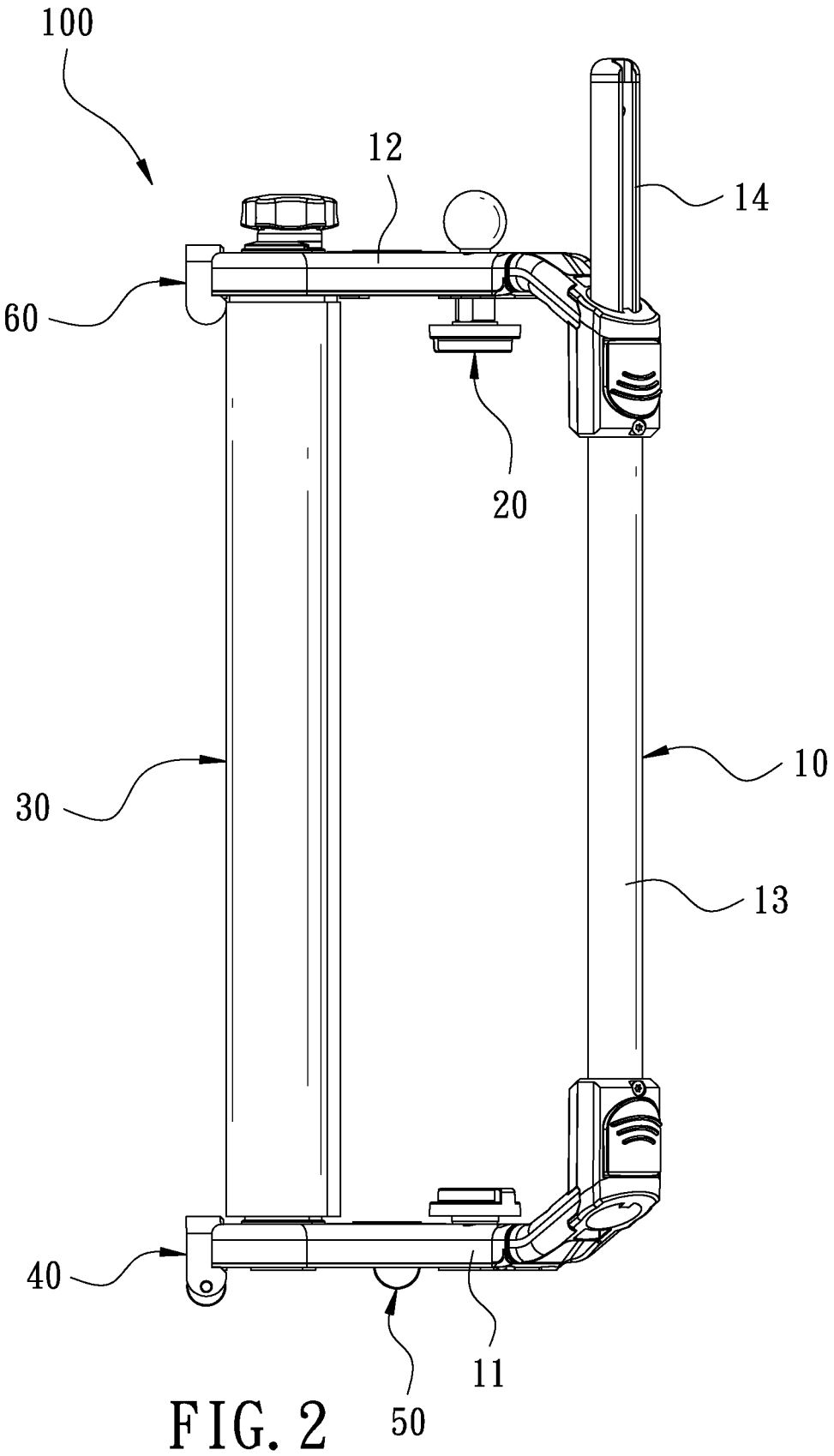
FIG. 2 is a side view according to the preferred embodiment of the present invention.

FIG. 1 and FIG. 2 are a perspective view and a side view of a preferred embodiment of the present invention. The present invention discloses a stretch film dispenser with a moving device. The moving device is mounted to the stretch film dispenser 100. The stretch film dispenser 100 includes a frame 10. The frame 10 is provided with a film mounting unit 20 and a film dispensing unit 30.

Figure 3:
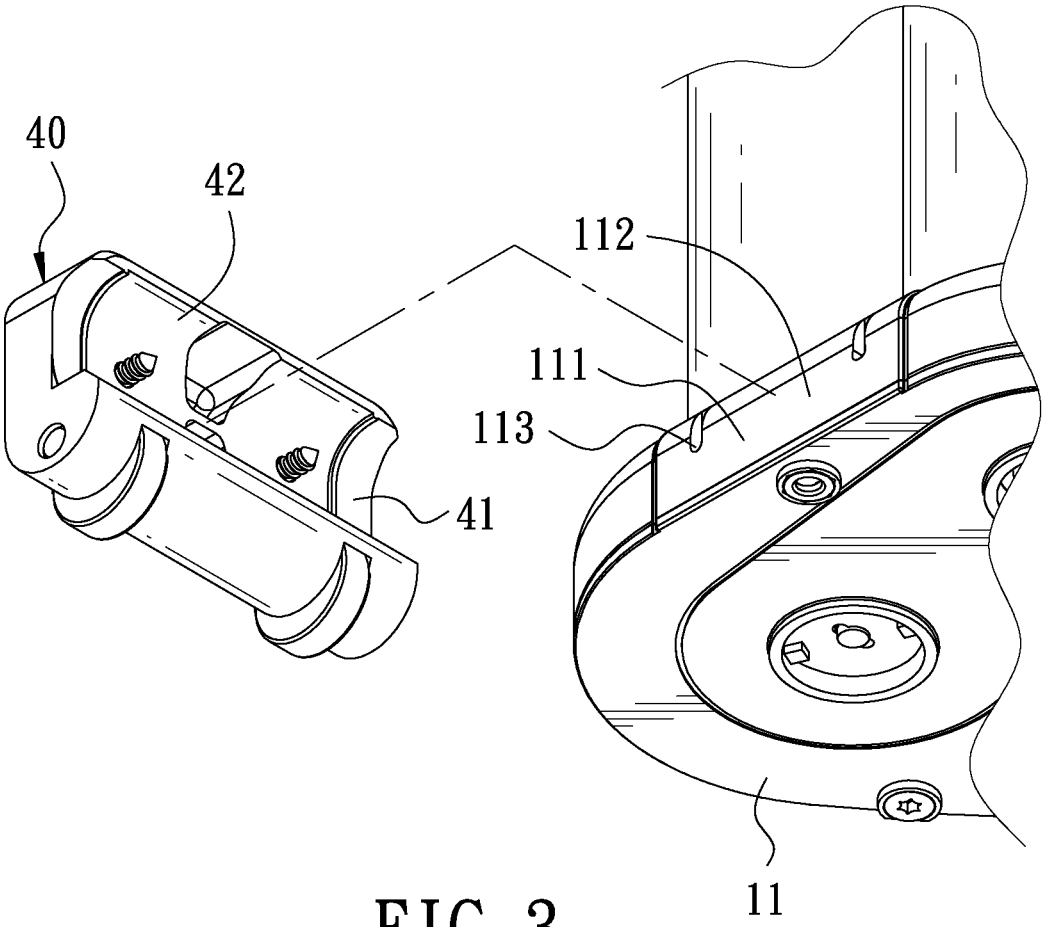
FIG. 3 is a partially exploded view according to the preferred embodiment of the present invention, showing the bottom seat and the moving unit.
Figure 4:
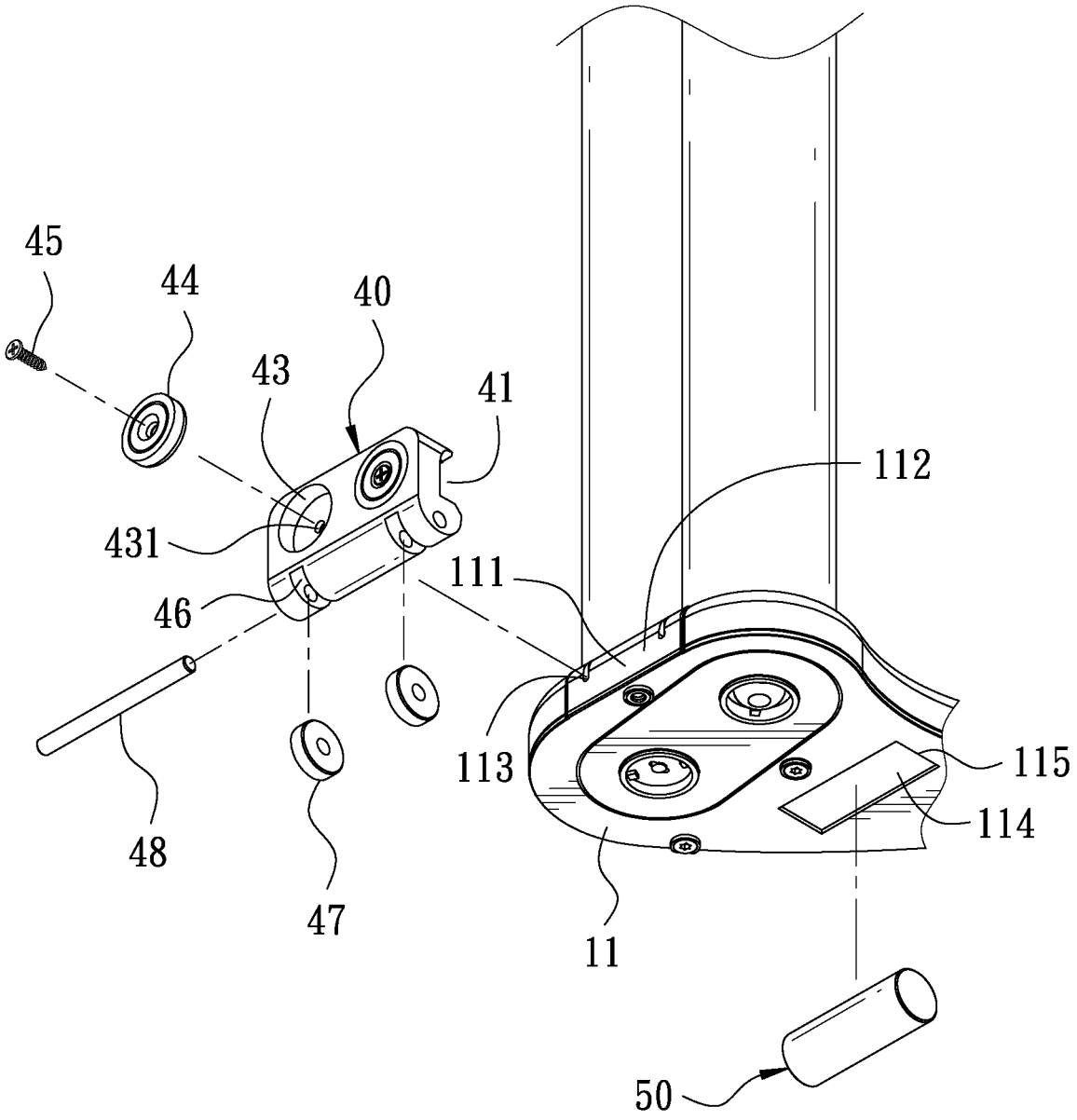
FIG. 4 is an exploded view of the moving unit and the second moving member according to the preferred embodiment of the present invention.
Figure 5:
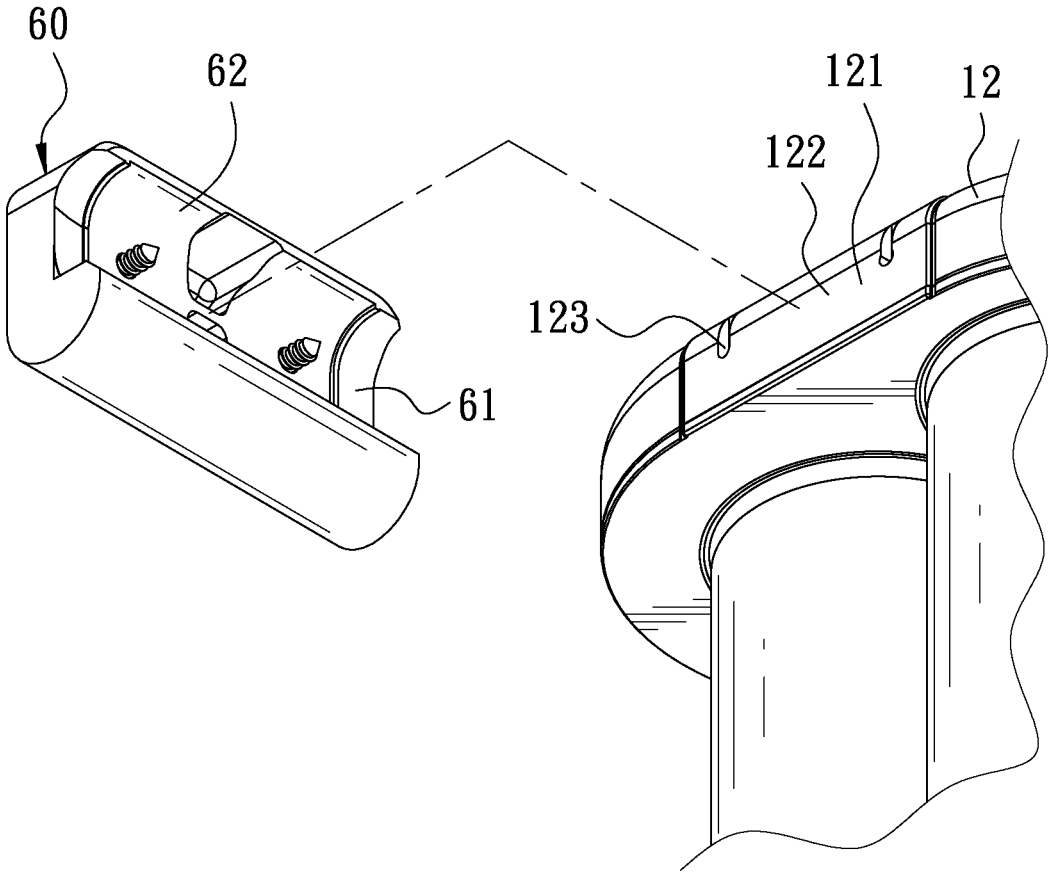
FIG. 5 is a partially exploded view according to the preferred embodiment of the present invention, showing the coupling seat and the fixing unit.
Figure 6:
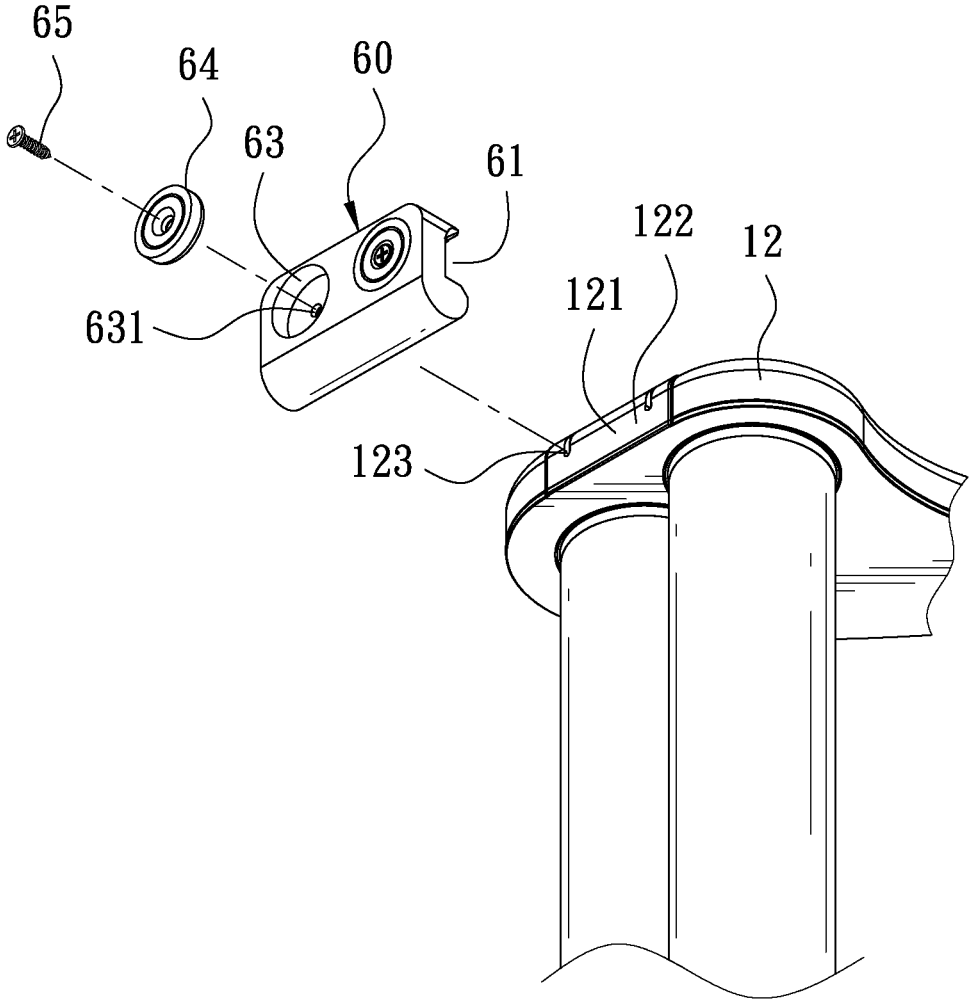
FIG. 6 is a partially exploded view according to the preferred embodiment of the present invention, showing the coupling seat and the fixing unit viewed in another direction.

The frame 10 includes a bottom seat 11, a coupling seat 12, and a tubular member 13 connected between the bottom seat 11 and the coupling seat 12. The tubular member 13 is provided with a telescopic rod 14. As shown in FIG. 3 and FIG. 4, a first positioning portion 111 is disposed on a side wall of the bottom seat 11. A first positioning block 112 is disposed on the first positioning portion 111. The first positioning block 112 has two first fixing holes 113. The bottom surface of the bottom seat 11 is provided with an accommodating groove 114 and an opening 115 corresponding in position to the accommodating groove 114. The opening 115 communicates with the accommodating groove 114. Referring to FIG. 5 and FIG. 6, a second positioning portion 121 is disposed on a side wall of the coupling seat 12. The second positioning portion 121 is disposed in parallel with the first positioning portion 111. A second positioning block 122 is disposed on the second positioning portion 121. The second positioning block 122 has two second fixing holes 123.

A moving unit 40 is provided on the bottom seat 11 of the frame 10 and disposed on the first positioning portion 111. Please refer to FIG. 3 and FIG. 4, the moving unit 40 has a first engaging trough 41 corresponding to the first positioning portion 111. A peripheral wall of the first engaging trough 41 has a first positioning groove 42 corresponding in position to the first positioning block 112, so that the moving unit 40 is engaged with the first positioning portion 111 of the bottom seat 11. Another side wall of the moving unit 40 is formed with first receiving troughs 43 corresponding in position to the first fixing holes 113. A first perforation 431 is formed in the bottom of each of the first receiving troughs 43. Each of the first receiving troughs 43 is provided with a first fixing member 44. A first screw 45 is inserted through the first fixing member 44 and screwed to the first fixing hole 113. In this embodiment, the first fixing member 44 is a magnet. The bottom of the moving unit 40 is provided with two slots 46. The slots 46 are configured to accommodate first moving members 47. A shaft 48 is inserted through the moving unit 40 and the first moving members 47 for positioning the first moving members 47. In the embodiment, the first moving members 47 are rollers.

A second moving member 50 is provided in the accommodating groove 114 of the bottom seat 12. The second moving member 50 is accommodated in the accommodating groove 114. A portion of the second moving member 50 is exposed out of the opening 115. The central axis of the second moving member 50 is parallel to the central axis of the first moving member 47. In the embodiment, the second moving member 50 is a roller.

A fixing unit 60 is provided on the coupling seat 12 of the frame 10 and disposed on the second positioning portion 121. Please refer to FIG. 5 and FIG. 6, a side wall of the fixing unit 60 has a second engaging trough 61 corresponding to the second positioning portion 121. A peripheral wall of the second engaging trough 61 has a second positioning groove 62 corresponding in position to the second positioning block 122, so that the fixing unit 60 is engaged with the second positioning portion 121 of the coupling seat 12. Another side wall of the fixing unit 60 is formed with second receiving troughs 63 corresponding in position to the second fixing holes 123. A second perforation 631 is formed in the bottom of each of the second receiving troughs 63. Each of the first second troughs 63 is provided with a second fixing member 64. A second screw 65 is inserted through the second fixing member 64 and screwed to the second fixing hole 123. In this embodiment, the second fixing member 64 is a magnet.

Figure 7:
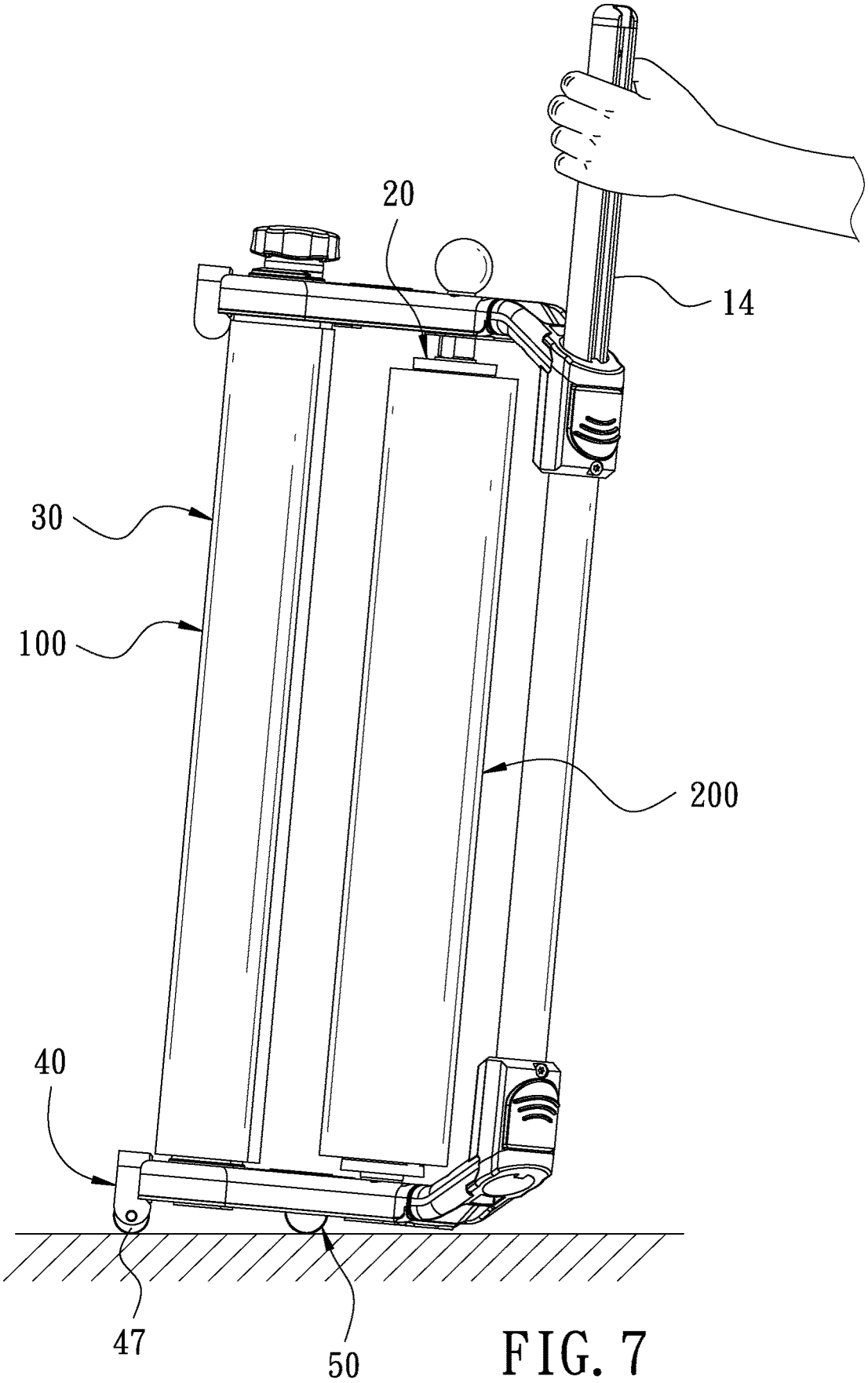
FIG. 7 is a schematic view according to the present invention when in use, showing that the stretch film dispenser is moved.

When the user wants to use the stretch film dispenser 100, a film roll 200 is first mounted on the film mounting unit 20, and then the film of the film roll 200 is wound around the film dispensing unit 30, so that the stretch film dispenser 100 can be used. Referring to FIG. 7, when the user wants to move the stretch film dispenser 100, the telescopic rod 14 is first pulled up to a height suitable for holding, and then the user holds the telescopic rod 14 to pull the stretch film dispenser 100. At this time, the stretch film dispenser 100 can be moved through the first moving members 47 and the second moving member 50, thereby achieving the effect of moving the stretch film dispenser 100 easily and conveniently.

It is worth mentioning that when the user wants to pack an article that is located at a lower position, the stretch film dispenser 100 can be placed on the ground, and the telescopic rod 14 can be adjusted to a height suitable for holding, and then the user holds the telescopic rod 14 to move the stretch film dispenser 100 for packing the article, thereby enabling the stretch film dispenser 100 to pack the article easily.

Figure 8:
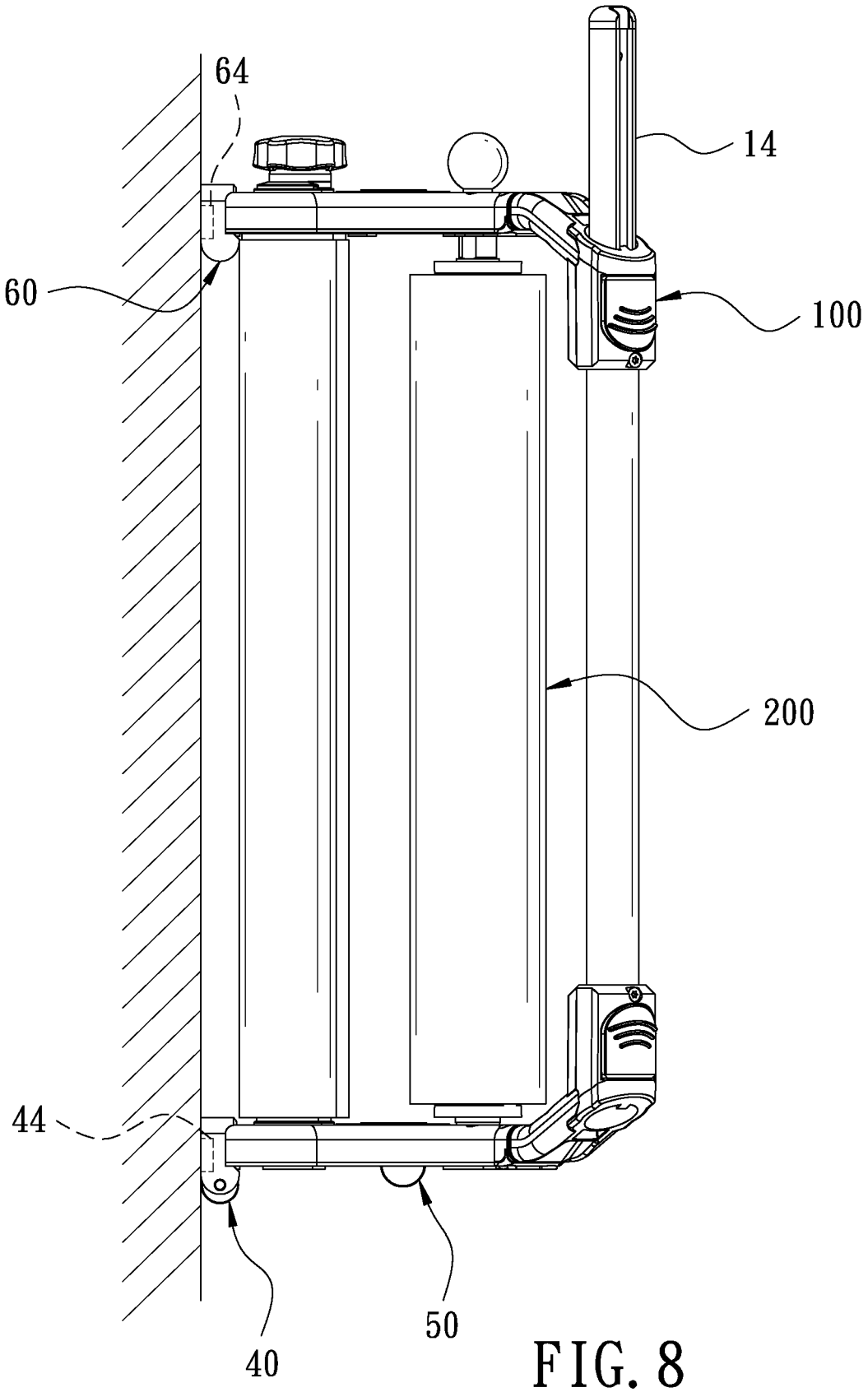
FIG. 8 is a schematic view according to the present invention when in use, showing that the stretch film dispenser is attached to the wall.
Figure 9:
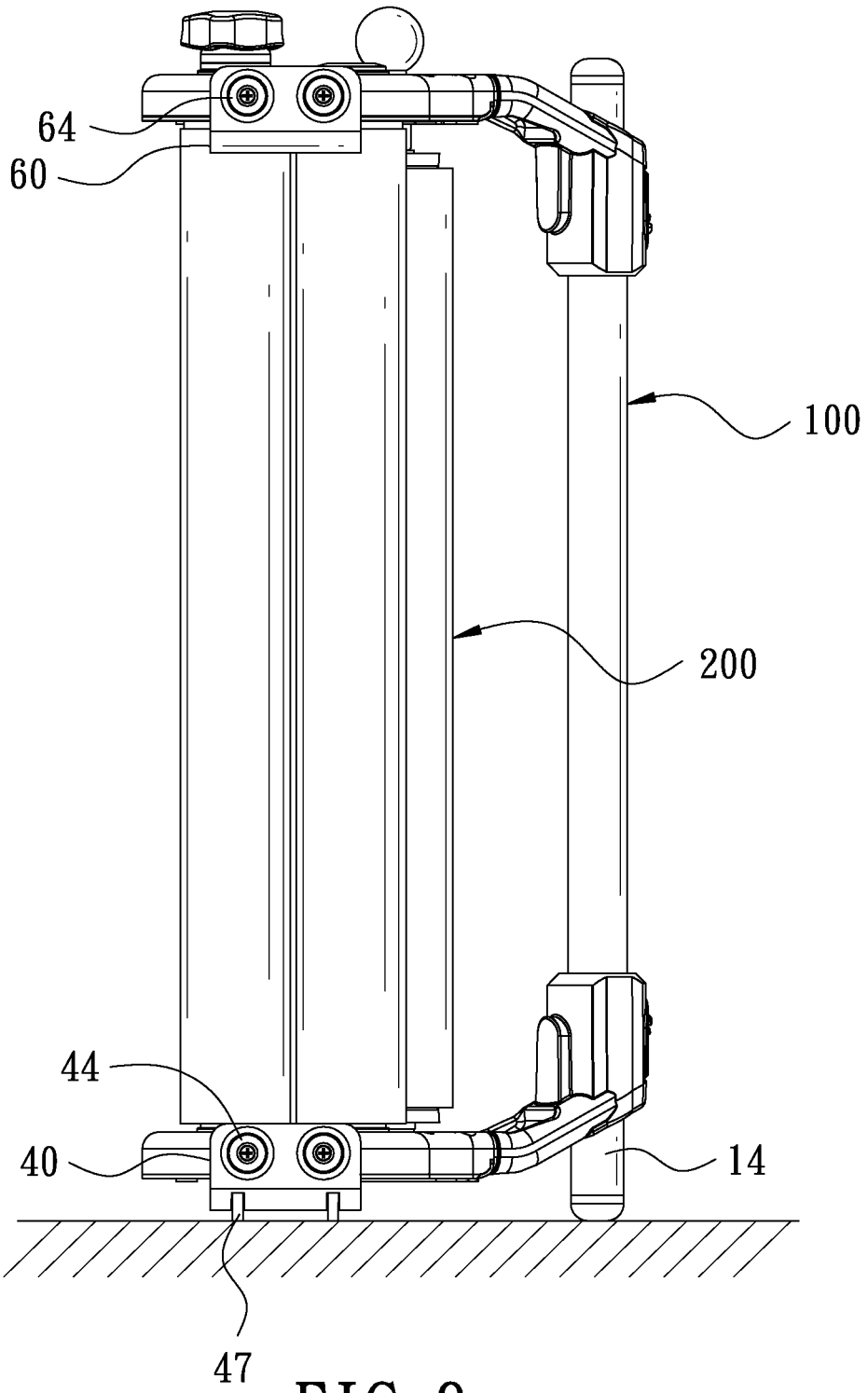
FIG. 9 is a schematic view according to the present invention when in use, showing that the stretch film dispenser is placed on the ground.

Referring to FIG. 8, when the stretch film dispenser 100 is not in use, the stretch film dispenser 100 can be attached to a wall having magnetism through the first fixing member 44 and the second fixing member 64. Referring to FIG. 9, in addition to being attached to the wall having magnetism, the stretch film dispenser 100 can stretch the telescopic rod 14 downwardly, such that the first moving members 47 and the telescopic rod 14 form three support points for the stretch film dispenser 100 to be placed flat on the ground. Thereby, the user can select the stretch film dispenser 100 to be attached to the wall having magnetism or to be placed flat on the ground, thereby facilitating the storage of the stretch film dispenser 100.

Figure 10:
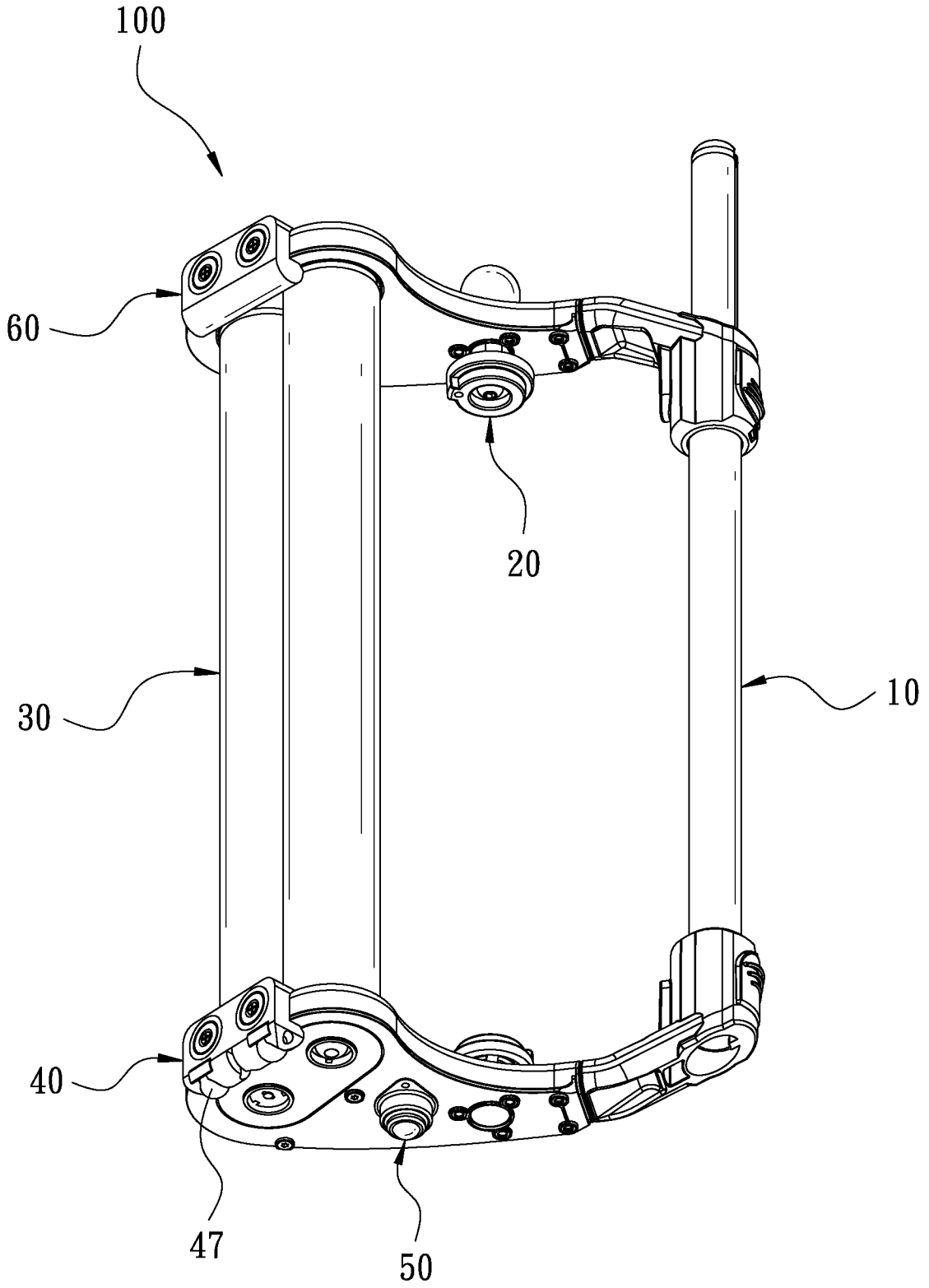
FIG. 10 is a perspective view according to another embodiment of the present invention.

Referring to FIG. 10, in another embodiment of the present invention, the first moving members 47 and the second moving member 50 are universal ball bearing wheels. When the stretch film dispenser 100 is pulled and moved by the user, the first moving members 47 and the second moving member 50 rotate simultaneously, so that the user can move the stretch film dispenser 100 to any position easily.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A stretch film dispenser with a moving device, comprising a frame, the frame including a bottom seat and a coupling seat, characterized by:

a tubular member being connected between the bottom seat and the coupling seat, the tubular member being provided with a telescopic rod, a side wall of the bottom seat having a first positioning portion, a first positioning block being disposed on the first positioning portion;

a moving unit being provided on the first positioning portion of the bottom seat, the moving unit having a first engaging trough corresponding to the first positioning portion, a peripheral wall of the first engaging trough having a first positioning groove corresponding in position to the first positioning block, the moving unit being engaged with the first positioning portion of the bottom seat, a bottom surface of the moving unit being provided with at least one first moving member.

2. The stretch film dispenser with the moving device as claimed as claim 1, wherein the first positioning block of the bottom seat has two first fixing holes, the moving unit is formed with first receiving troughs corresponding in position to the first fixing holes, each of the first receiving troughs is provided with a first fixing member, and a first screw is inserted through the first fixing member and screwed to a corresponding one of the first fixing holes.

3. The stretch film dispenser with the moving device as claimed as claim 2, wherein the first fixing member is a magnet.

4. The stretch film dispenser with the moving device as claimed as claim 1, wherein a bottom of the moving unit is provided with two slots, the slots are configured to accommodate the first moving member, and a shaft is inserted through the moving unit and the first moving member for positioning the first moving member.

5. The stretch film dispenser with the moving device as claimed as claim 1, wherein the first moving member is one of a roller and a universal ball bearing wheel.

6. The stretch film dispenser with the moving device as claimed as claim 1, wherein a side wall of the coupling seat has a second positioning portion, the second positioning portion is disposed in parallel with the first positioning portion, a second positioning block is disposed on the second positioning portion, a fixing unit is provided on the second positioning portion of the coupling seat, the fixing unit has a second engaging trough corresponding to the second positioning portion, a peripheral wall of the second engaging trough has a second positioning groove corresponding to the second positioning block, and the fixing unit is engaged with the second positioning portion.

7. The stretch film dispenser with the moving device as claimed as claim 6, wherein the second positioning portion of the coupling seat has two second fixing holes, the fixing unit is formed with second receiving troughs corresponding to the second fixing holes, a second perforation is formed in a bottom of each of the second receiving troughs, each of the first second troughs is provided with a second fixing member, and a second screw is inserted through the second fixing member and screwed to a corresponding one of the second fixing hole.

8. The stretch film dispenser with the moving device as claimed as claim 7, wherein the second fixing member is a magnet.

9. The stretch film dispenser with the moving device as claimed as claim 1, wherein a bottom surface of the bottom seat is provided with an accommodating groove and an opening corresponding in position to the accommodating groove, the opening communicates with the accommodating groove, a second moving member is provided in the accommodating groove, and a central axis of the second moving member is parallel to a central axis of the first moving member.

10. The stretch film dispenser with the moving device as claimed as claim 9, wherein the second moving member is one of a roller and a universal ball bearing wheel.

* * * * *